US005253642A

United States Patent [19]

Stackhouse et al.

[11] Patent Number: 5,253,642

[45] Date of Patent: Oct. 19, 1993

[54] SURGICAL GOWN

[75] Inventors: Wyman H. Stackhouse; Mildred K. Stackhouse, both of Manhatten Beach; Richard J. Greff, Yorba Linda; Frederic S. Bongard, Redondo Beach; Stanley R. Klein, Palos Verdes, all of Calif.

[73] Assignee: Stackhouse, Inc., Riverside, Calif.

[21] Appl. No.: 858,324

[22] Filed: Mar. 25, 1992

[51] Int. Cl.[5] ..... A62B 17/00; A62B 18/00

[52] U.S. Cl. ..... 128/205.29; 128/201.25; 128/201.29

[58] Field of Search ..... 128/201.25, 201.29, 128/205.29, 200.24, 206.23, 206.19, 206.12; 2/DIG. 7

[56] References Cited

U.S. PATENT DOCUMENTS

| | | | |
|---|---|---|---|
| H805 | 8/1990 | Schriver | 128/201.22 |
| 1,931,562 | 10/1933 | Thompson | 128/201.29 X |
| 2,779,331 | 1/1957 | Trexler | 128/201.29 |
| 3,525,334 | 8/1970 | Braman | 128/201.29 X |
| 3,529,594 | 9/1970 | Charnley | 128/201.29 |
| 3,781,916 | 1/1974 | Vitol | 2/DIG. 7 X |
| 3,790,964 | 2/1974 | Hartigan | 340/471 |
| 3,868,728 | 4/1975 | Krzewinski | 2/114 |
| 3,943,575 | 3/1976 | Bolker | 2/205 |
| 3,955,570 | 5/1976 | Hutter | 128/201.23 |
| 4,016,604 | 4/1977 | Welke | 2/DIG. 7 X |
| 4,019,508 | 4/1977 | Der Estephanian | 128/202.19 |
| 4,055,173 | 10/1977 | Knab | 128/847 |
| 4,408,357 | 10/1983 | Toth | 2/114 |
| 4,504,977 | 3/1985 | King | 2/51 |
| 4,586,196 | 5/1986 | White | 2/114 |
| 4,651,727 | 3/1987 | Howorth | 128/201.23 |
| 4,736,467 | 4/1988 | Schwarze | 2/114 |
| 4,845,779 | 7/1989 | Wheeler | 2/84 |
| 4,901,716 | 2/1990 | Stackhouse | 128/201.25 |
| 4,932,078 | 6/1990 | Jones | 2/DIG. 7 X |
| 4,942,987 | 7/1990 | Stackhouse | 2/DIG. 7 X |
| 5,033,115 | 7/1991 | Bowling | 2/DIG. 7 X |
| 5,042,474 | 8/1991 | Williamson | 128/206.12 |
| 5,054,480 | 10/1991 | Bare | 128/201.25 |

*Primary Examiner*—J. Reed Fisher
*Assistant Examiner*—Eric P. Raciti
*Attorney, Agent, or Firm*—Richard L. Myers

[57] ABSTRACT

An integral surgical gown incudes a body tube with front and back portions, and shoulder portions supporting the gown on a user. A pair of body sleeves and a hood assembly are permanently attached to the body tube. The hood assembly includes a hood, and a transparent shield and mask permanently attached to the hood. Fluid impervious panels cover the sleeves and front of the body tube while an open mesh provides ventilation at the back portions of the body tube. By merely donning the single integral gown, these protective elements are automatically positioned on the user.

6 Claims, 2 Drawing Sheets

Fig. 3

SURGICAL GOWN

BACKGROUND OF THE INVENTION

1. Field of the Invention

This invention relates generally to protective clothing adapted for use by health care workers and more specifically to an integral gown adapted to inhibit the transmission of blood-borne disease.

2. Discussion of the Prior Art

As early as the 1890's protective clothing for health care workers was advocated in the prevention of disease transmission. Initially it was found that the use of rubber gloves during surgery resulted in a decrease rate of infection in patients. In more recent times, the focus has been on the prevention of bacterial infection of the patient. Surgical gowns, face masks, rubber gloves and boots have been widely used for that purpose. However, surgeons traditionally have paid little attention to their own risk of exposure to infectious diseases.

The failure of commonly practiced barrier methods to protect the surgeon and other members of his surgical team has been evidenced by the prevalence in surgeons of antibodies to hepatitis B, where the rate of infection is three to ten times that of the general population. In one large study, antibodies to hepatitis B were found in 28% of the surgeons. More recently, an increase in the number of patients having Acquired ImmunoDeficiency Syndrome (AIDS), has led hospitals and surgeons to become even more conscious of barrier apparatus and methods. In one prominent hospital, the prevalence of the HIV virus among the critically ill or injured patient almost doubled between 1986 and 1987.

While infection barriers are of interest throughout the health care environment, certain environments and procedures are particularly at risk. For example, contamination is very common in operative orthopedic procedures. In one study, 90% of the surgeons had been contaminated during some type of orthopedic procedure, and there was a particularly high percentage of contamination of the surgeons' faces. The operating room presents a particularly critical environment. In these environments where the profuse bleeding of ill or injured patients is common, one study indicated that health care workers took the time to don suitable barrier equipment only 19.7% of the time as compared with 62.9% of the time where patients were not bleeding. The haste of responding to trauma also reduced protection during the performance of major procedures (which usually required skill without delay) as opposed to minor interventions (which usually required less haste or skill).

The absence of suitable barrier equipment which is simply and quickly donned, has added to the liability of hospitals and increased significantly the health care workers's exposure to career limiting and life threatening disease.

SUMMARY OF THE INVENTION

In accordance with the present invention, an integral surgical gown is provided which can be easily, simply and quickly donned. The gown includes protective barrier panels which protect the front and arms of the user, and a hood assembly that includes a face mask and an eye shield which are permanently attached and automatically brought into place when the gown is initially donned. The eye shield is provided in the form of a flexible transparent plastic sheet which can be packed in a flat configuration but which can be bent around the face when operatively positioned. Ties can be provided for the eye shield and face mask to facilitate maintenance of the conforming configuration of the hood assembly. A back panel provided in the form of a mesh facilitates ventilation. The gown, which is initially donned by pulling it over the head of a user, can be provided with a rip seam to facilitate removal and disposal by the user.

DESCRIPTION OF PREFERRED EMBODIMENTS AND BEST MODE OF THE INVENTION

Figure 1:
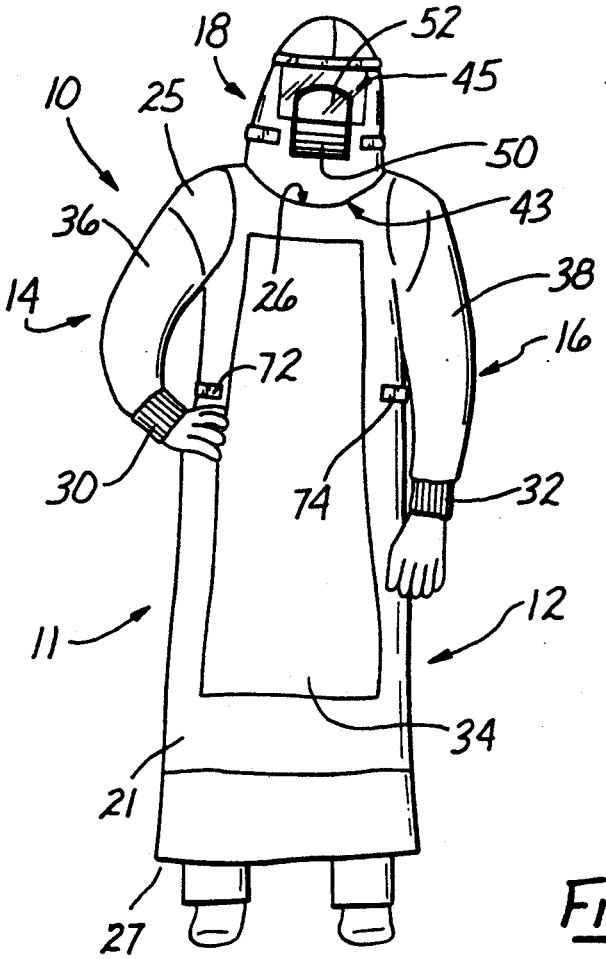
FIG. 1 is a front perspective view of a preferred embodiment of the surgical gown of the present invention operatively disposed on a user.

A surgical gown is illustrated in FIG. 1 and designated generally by the reference numeral 10. As illustrated, the gown 10 is operatively disposed on a user and comprises a flexible drape 11 which includes a body portion 12, a pair of sleeves 14, 16, and a hood 18. The body portion 12 includes front portions 21, rear portions 23, and shoulder portions 25 which support the body portion 12 on the shoulders of the user. The shoulder portions 25 define an opening 26 at the top of the body portion 12 which is of a size sufficient to receive the head and neck of the user. Knit cuffs 30 and 32 can be provided at the end of the sleeves 14, 16 respectively to help maintain the integrity of the gown.

In a preferred embodiment, the front portion 21, the sleeve 14, 16, and the hood 18 are formed from a conventional woven polyester fabric or non-woven fabric such as Sontara 851 marketed by DuPont de Nemours. This material is generally resistant to the passage of contaminated fluids and aerosols but has some ability to pass air to the user. Ventilation of the interior regions of the gown are enhanced by providing the rear portions 23 in the form of an open breathable mesh such as that marketed by Veratec Corporation as 1.4 mil white spun laced polypropylene.

In the illustrated embodiment, the body portions 12 of the gown 10 are formed with an opening 27 at the bottom and the gown 10. This opening 27 makes it possible for the gown 10 to be donned over the head of the user. It will be apparent that the body portions 12 can be otherwise embodied with a vertical opening such as a side, front or rear opening, facilitating access to the gown 10. However, it has been found that such openings typically need don such an embodiment. If these vertical openings are provided, suitable closures in the form of snaps, ties, hook and loop closures, and zippers can be provided in a conventional manner.

Even in an embodiment where the body portions 12 are closed and the gown 10 is designed to be donned over the head of a user, an irreversibly openable seam 40 may be provided in the body portions 12 to facilitate removal of the gown 10. In a particular embodiment, this seam 40 may take the form of a thread sewn across an opening in the form of a strippable stitch.

Figure 2:
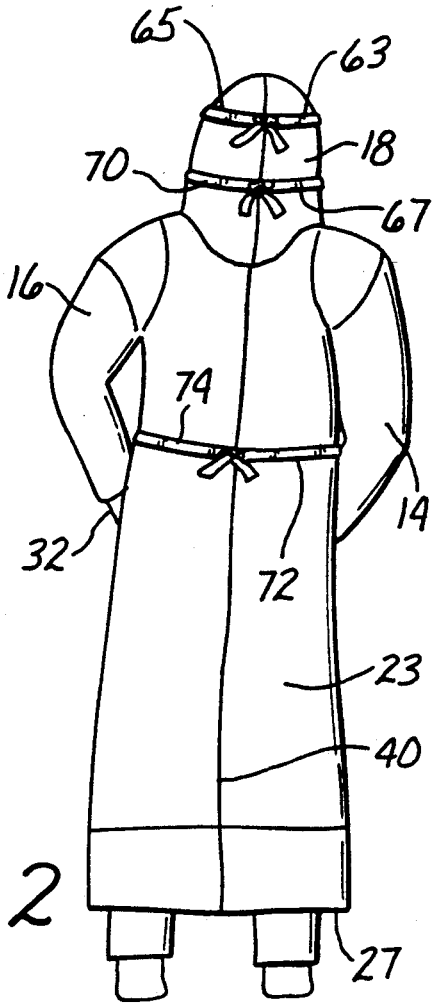
FIG. 2 is a back perspective view of the gown of FIG. 1 operatively disposed on a user.

Further ties may be provided where it is desirable to maintain the gown 10 in a conforming relationship with the user. For example, in the illustrated embodiment, FIGS. 1 and 2, a pair of ties 72 and 74 are provided for attachment around the waist of the user.

In order to increase the integrity of the gown, a front panel 34 of flexible impervious material can be provided for attachment, by gluing or other suitable means, to the front portion 21 of the gown 10. Similar sleeve panels 36 and 38 can be formed from the same material and attached to at least the lower surface of the sleeves 14, 16, respectively. In a preferred embodiment, the flexible impervious material comprises a 2.25 mil USI poly sheeting, embossed and anti-stat treated which is marketed by Bonar.

Figure 4:
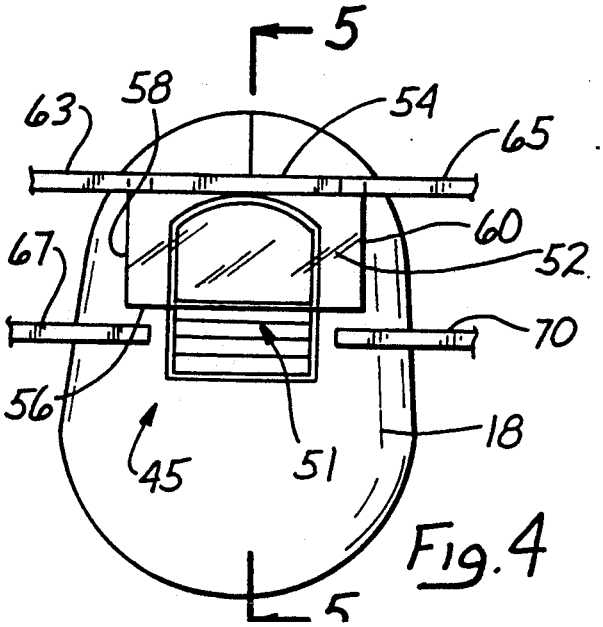
FIG. 4 is a front elevation view of one embodiment of the hood assembly of the present invention.
Figure 5:
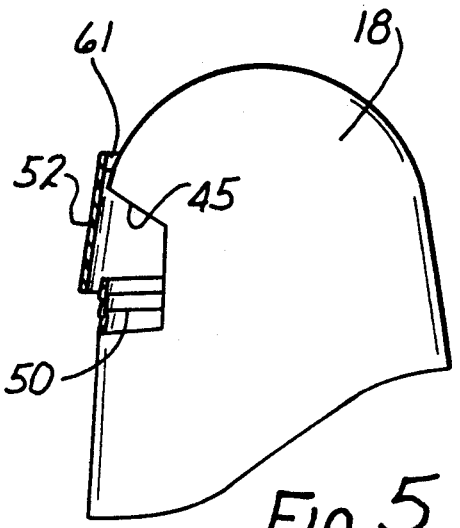
FIG. 5 is a cross-section view of the hood assembly taken along lines 5—5 of FIG. 4.
Figure 3:
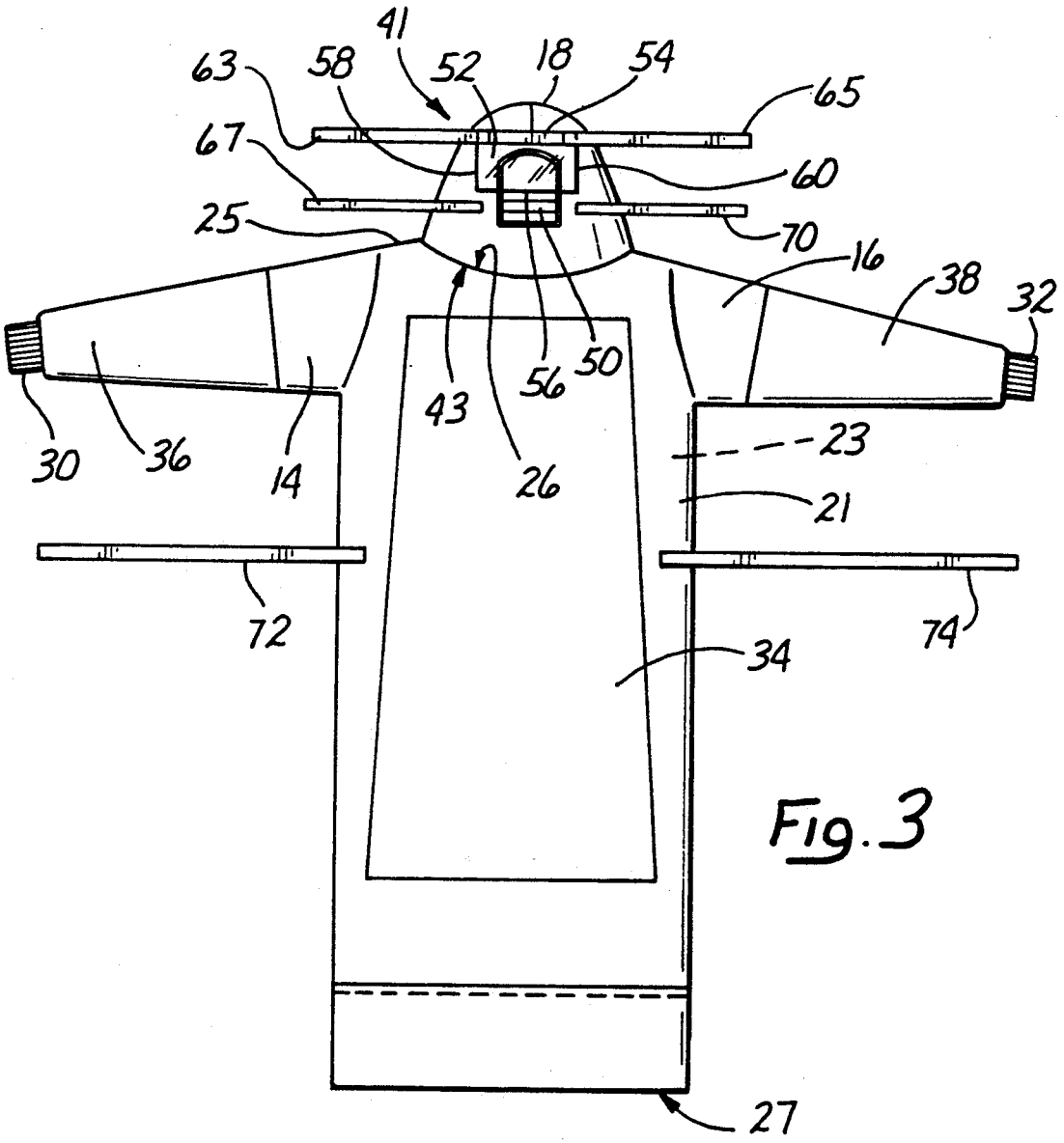
FIG. 3 is a front plan view of an embodiment of the surgical gown of the present invention.
Figure 6:
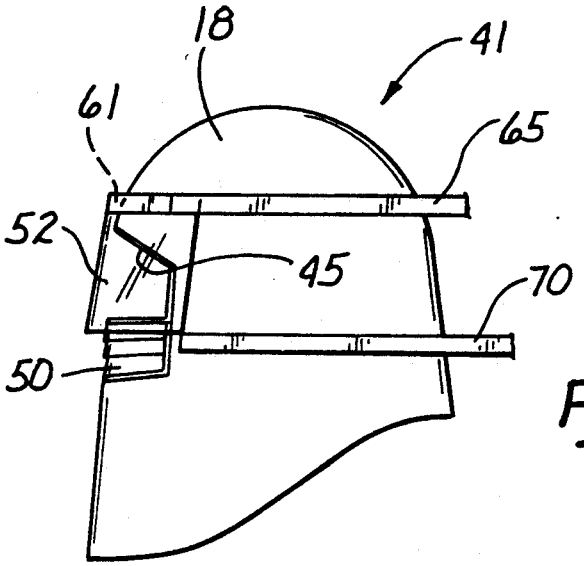
FIG. 6 is a side view of the hood assembly illustrated in FIG. 4.

The hood 18 forms part of a hood assembly 41 which is best illustrated in FIGS. 4–6. This assembly 41 can be formed as a separate article of barrier clothing, a subassembly for the surgical gown 10, or an integral part of the surgical gown 10. If the hood assembly 41 is permanently attached to the body portion 12 of the gown 10, it is preferable that the hood 18 be provided with a configuration having an increasing diameter as it extends downwardly to an opening 43. With this configuration, the head of the user is funneled into the hood 18 as the gown 10 is initially donned.

Portions of the hood 18 define a face opening 45 on the forward side of the hood 18. This opening 45 is generally positioned so that the hood 18 does not cover the eyes, nose or mouth of the user.

A surgical mask is permanently attached to the hood by glue, heat sealing, stitching or other suitable means. The mask 50 is positioned to extend across the face opening 45 and to cover the nose and mouth of the user. In a preferred embodiment, the face mask 50 is attached to the hood 18 on the inside of the opening 45 and includes a bendable nosepiece 51.

An eye shield 52 is permanently coupled to the hood 18 and positioned to extend across the face opening 45 over the eyes of the user. The face shield can be formed of any suitable, flexible, transparent material which is impervious to the contaminated liquids and aerosols. In a preferred embodiment, the shield 52 is coupled to the hood 18 by a flexible seal 61 which can be formed from any suitable material such as cellular foam. The seal 61 also functions as a spacer to separate the shield 52 from the nose of the user and any eyeglasses worn by the user.

The eye shield 52 is bendable from a transportable state that is relatively flat to an operative state where the shield is bent into general conformity across the face of the user. The flexible nature of the material forming the seal 61, facilitates this bending and conformity while maintaining a seal between the shield 52 and the hood 18. A suitable glue can be used to attached the seal 61 to the shield 52 and the hood 18.

The eye shield 52 in a preferred embodiment has a generally rectangular configuration and extends between a top edge 54, a bottom edge 56 and a pair of side edges 58 and 60.

In order to maintain the shield 52 in the operative bent conforming configuration, a pair of ties 63 and 65 can be provided to engage the eye shield 52 in proximity to the top edge 54. In use, the ties 63 and 65 can be drawn around and tied behind the head of the user.

A preferred embodiment of the invention includes a second pair of ties 67 and 70 which can be attached to the hood 18 or the face mask 50 to hold the mask 50 in operative sealed relationship with the face of the user. These ties 67, 70 also can be drawn around and tied behind the head of the user.

In accordance with the foregoing description, a surgical gown is provided which protects the wearer from spills, splashes of blood, biological fluids, aerosols, and other liquids during the administration of care to a patient. It also offers increased patient protection. Importantly, the gown 10 can be easily donned bringing into operative disposition all of the barrier elements required for isolation. Thus by merely donning the drape, the face mask 50, eye shield 52, front panel 34 and sleeve panels 36, 38, are automatically brought into position. Surgeons and other health care personnel who heretofore have only had time to don a mask and cap, will automatically be covered with these additional barriers for their protection.

Although the invention has been described with reference to specific embodiments it will be apparent that the concept can be otherwise embodied. For example, different materials and shapes can be provided for the various elements of the drape 11. Other materials and shapes can also be provided for the impervious barrier panels 34, 36, and 38 It will also be within the skill of the art to contemplate other combinations, materials and shapes for the mask 50, eye shield 52 and hood 18. Other means for sealing the mask 50 and shield 52 may also be of interest.

Based on these considerations and the obvious adjustments which can be made within the present concept, the scope of the invention should not be ascertained merely with reference to the disclosed embodiments, but rather with a careful review of the following claims.

We claim:

1. A surgical gown adapted to protect a user from contaminated body fluids, comprising:

an integral drape including a body tube with front portions and back portions, a pair of sleeves, and a hood with portions defining an opening for the face of the user;

first protective means for covering the front portions and sleeves of the drape, comprising a sheet material with properties impervious to the contaminated fluids; portions of the hood defining an opening for the face of the user;

second protective means for covering at least a portion of the opening of the hood, the second protective means comprising a transparent eye shield impervious to the contaminated fluid and having properties for being bent from a generally flat transportable configuration to a generally curved operative configuration;

retention means coupled to the eye shield exteriorly of this hood for bending the eye shield from the flat transportable configuration to the curved operative configuration and for releasably retaining the eye shield in the curved operative configuration in front of the eyes of the user;

third protective means for covering the remainder of the opening of the hood, formed from a material having properties for facilitating breathing through the mouth of the user while inhibiting passage of the contaminated fluids through the mask; and means for attaching the sheet material, the shield, and the mask to the drape to form an integral unit having properties for bringing each of the protective means into operative disposition when the drape is initially donned by the user.

2. The surgical gown recited in claim 1 wherein the back portions of the body tube comprise an open mesh having properties which facilitate ventilation of the surgical gown.

3. The surgical gown recited in claim 1 wherein:

the shield extends to a top edge, a bottom edge, and two side edges; and the retention means comprises a pair of ties each extending laterally from an associated one of the side edges of the shield in proximity to the top edge of the shield.

4. The surgical gown recited in claim 1 wherein the attaching means includes a strip of foam disposed between the shield and the drape for attaching the shield to the drape.

5. The surgical gown recited in claim 1 wherein the body tube includes an irreversibly openable seam facilitating removal of the gown.

6. The surgical gown recited in claim 1 wherein the eye shield in its curved operative configuration is spaced from the mask in its operative disposition to facilitate ventilation.

* * * * *